United States Patent [19]

Stobb

[11] Patent Number: 4,509,415

[45] Date of Patent: Apr. 9, 1985

[54] METHOD AND APPARATUS FOR SUPPLYING STRAP TO AN ITEM

[75] Inventor: Walter J. Stobb, Pittstown, N.J.

[73] Assignee: Stobb, Inc., Clinton, N.J.

[21] Appl. No.: 542,650

[22] Filed: Oct. 17, 1983

[51] Int. Cl.[3] ..... B65B 13/04

[52] U.S. Cl. ..... 100/2; 53/399; 53/589; 100/7; 100/26; 242/55.3; 242/105

[58] Field of Search ..... 100/2, 25, 26, 7, DIG. 912; 53/399, 589; 242/105, 55.3, 56 A

[56] References Cited

U.S. PATENT DOCUMENTS

| | | | |
|---|---|---|---|
| 3,443,512 | 5/1969 | Sauer | 100/26 |
| 3,521,550 | 7/1970 | Van Doorn | 100/26 |
| 3,733,769 | 5/1973 | Van Doorn | 100/26 X |
| 4,057,197 | 11/1977 | Rottmann | 242/55.3 X |
| 4,372,201 | 2/1983 | Dudziak | 100/7 |
| 4,412,484 | 11/1983 | Beethem | 100/7 |

*Primary Examiner*—Billy J. Wilhite

*Attorney, Agent, or Firm*—Arthur J. Hansmann

[57] ABSTRACT

Method and apparatus for supplying strap to an item, such as a bundle of sheets, and with two strapping mechanisms being made available to a fixed segment of a strap guide, such that either mechanism can be positioned in the operating position at any one time. Arrangement is made for shifting the two strapping mechanisms laterally into mating position with the fixed strap guide, and with each strapping mechanism carrying a segment of a strap guide for mating with and completing the fixed segment of strap guide. Provision is also made for removing the strapping mechanisms from a fixed strap guide or position, for servicing or the like.

18 Claims, 3 Drawing Figures

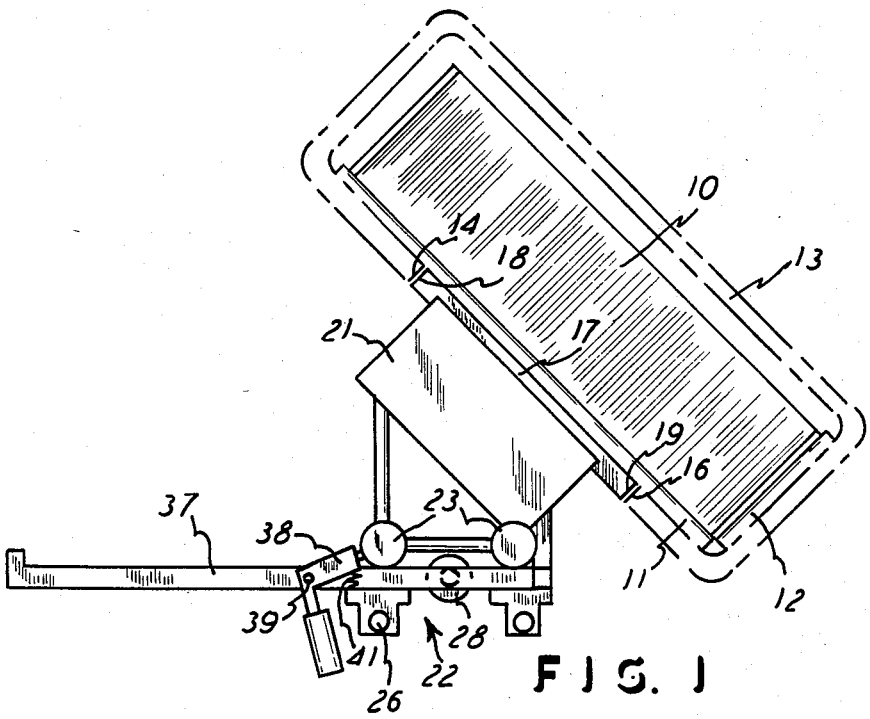
FIG. 1
FIG. 2
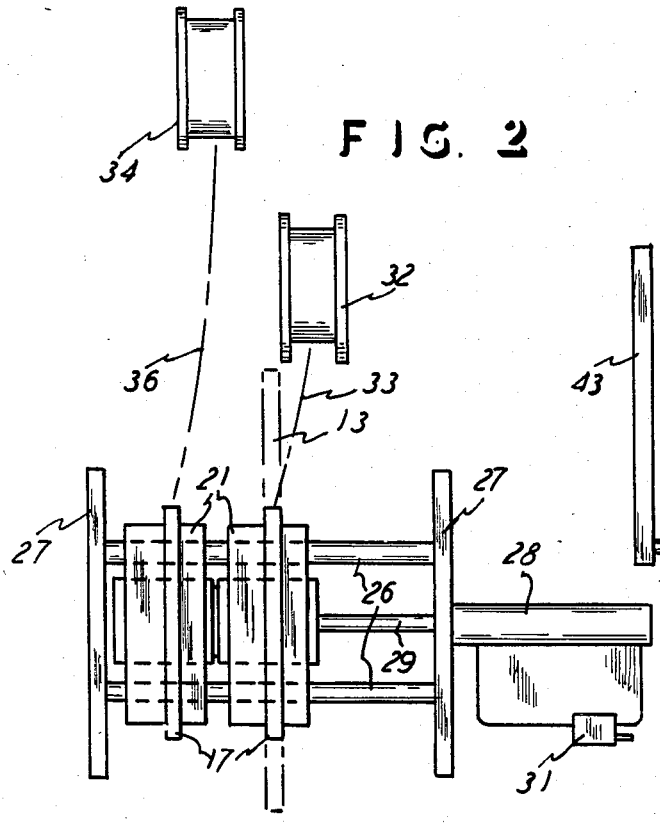
FIG. 3
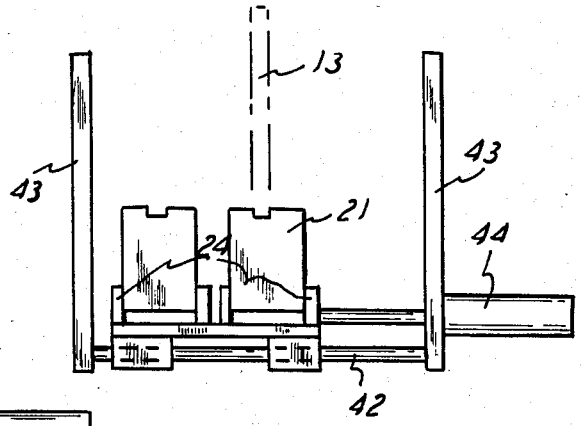

METHOD AND APPARATUS FOR SUPPLYING STRAP TO AN ITEM

This invention relates to a method and apparatus for supplying strap to an item, and, more particularly, it pertains to a method and apparatus for strapping an item with a back-up strapping mechanism which is available for avoiding down time in the event of apparatus problems.

BACKGROUND OF THE INVENTION

Applying a strap or binder to an item, such as a stack or bundle of sheets, is accomplished in industry by means of strapping mechanisms which apply the strap to the item. Commonly the item is moved to the strapping mechanism which is then activated and the strap is applied to bind the item. The strap mechanism is of course subject to mechanical failure and jamming and of course they run out of strap material. At those times, the entire production line must be shut down or detained while the strapping apparatus is attended to. That commonly encounters expensive and time-consuming down time, particularly where the strapping mechanism is employed for strapping bundles of sheets coming from the high-speed printing press.

The present invention provides a method and apparatus for avoiding any delays or down time in the employment of strapping processes and apparatus. The particular objective of this invention is accomplished by providing a back-up or additional type of strapping mechanism on a mounting which can be readily actuated to position either one of two strapping mechanisms into the operative position. Further, when one strapping mechanism is operating, the other strapping mechanism is available for servicing, including loading additional strap into the then idle strapping mechanism. In that manner, the high-speed production line is not at all interrupted, since either one of two strapping mechanisms is available at all times.

BRIEF DESCRIPTION OF THE DRAWINGS

FIG. 1 is a side elevational view of an embodiment of this invention.

FIG. 2 is a top plan view of a portion of FIG. 1, with parts added thereto and parts removed therefrom.

FIG. 3 is a top plan view of a somewhat different embodiment, but similar to the showing in FIG. 2.

DETAILED DESCRIPTION OF THE PREFERRED METHOD AND APPARATUS

In describing the apparatus shown in the drawings, the method will be inherently described and will be understood by one skilled in the strapping art.

FIG. 1 shows the item, in the form of a bundle of sheets 10, supported on a stacker or the like, which is shown to include support rollers 11 and 12 disposed at reclining angles for upwardly supporting the bundle 10, in the conventional manner. A strapping guide or tube 13 is shown in dot-dash lines to partially encircle the stack or bundle 10 in its longitudinal plane, and the guide 13 is the strap guide which is disposed in a fixed position, and the bundle 10 is moved to its shown position, namely, within the confines of the guide 13 and on the plane thereof, as mentioned.

The dot-dash lines showing the guide 13 is showing a first segment of the total or endless guide, and the segment has spaced-apart ends 14 and 16 which are in line with each other and which define a certain dimension or length therebetween, as shown. Of course it will be further understood that the strap guide 13 is of a configuration for guiding a strap (unshown) therearound to encircle the item or stack 10, and the strap is then pulled tightly onto the item 10 and is clamped or secured for holding the item 10 in a strapped position in the usual manner.

FIG. 1 further shows a second strap guide segment which is designated 17 and which is of a length from its one end 18 to its other end 19 equal to the length or spacing of the other guide ends 14 and 16. Thus the strap guide segment 17 mates with or fits between the ends 14 and 16, as shown in FIG. 1. In that manner, when the guide 17 is positioned in the longitudinal plane mentioned, that is in line with the fixed guide segment 13, then the guide segments 13 and 17 form an endless and one continuous strap guide, for the usual guiding of the unshown strap around the bundle 10.

Strapping mechanism 21 supports the guide segment 17, and it will be noticed that the segment 17 and the mechanism 21 are at a reclining angle which is parallel to the reclining angle of the sheet bundle 10. The mechanism 21 supports the guide segment 17 and positions the segment 17 into the space defined between the segment ends 14 and 16. That is, the mechanism 21 is movable transversely of the plane of the strap guide, since the mechanism 21 is supported on a mobile mounting generally designated 22.

The mechanism 21 is of a conventional construction, and it is supported on the mobile mounting 22 by means of wheels 23, as shown in FIG. 1, or by a clamp 24, as shown in FIG. 3.

FIG. 2 shows two strapping mechanisms 21, of the same conventional construction, and each supporting a novel strap guide segment 17. The mechanisms 21 are slidably supported on guide rods 26 secured in side frame pieces 27. A fluid cylinder 28 is mounted on the frame piece 27, and it has a rod 29 extending into connection with the mechanisms 21 for shifting them left and right, as viewed in FIG. 2, on the guide rods 26. A fluid control 31, which can be in the form of an air valve when cylinder 28 is an air cylinder, is mounted on the cylinder 28 and is available for manual control for the shifting of the mechanisms 21, as mentioned. FIG. 2 further shows the dot-dash line showing of the fixed strap guide segment 13, which shows the center plane which is the longitudinal plane of the bundle 10, as mentioned. Thus, when the right hand guide 21 is in alignment with the guide segments 13, then that guide mechanism 21 is available for operating to apply the strap to the bundle 10, and that strap is supplied from a strap reel 32 which has its strap 33, indicated by dot-dash line 33, extending to the mechanism 21 for the strapping operation.

When it is desired to shift the mechanisms 21 and have the other one in operative position on the center plane of the segment 13, then then cylinder 28 is actuated to move the mechanisms 21 to the right, as viewed in FIGS. 2 and 3, and then the left hand mechanism 21 is in operating position and its strap supply or reel 34 is supplying its strap 36 to its mechanism 21 for the strapping process.

As mentioned in connection with FIG. 1, the mechanism 21 may be on wheels 23 which in turn are supported by rails or interconnectors 37 to which the cylinder 28 is connected, and thus the entire rails 37 are supported on the guides 26 to be shiftable left and right for the purpose mentioned. Further, when it is desired to move the mechanisms 21 away from the stacker or like equipment, then the mechanisms 21 can be wheeled along the rails 37, such as shown leftward in FIG. 1. A stop member 38 is shown mounted on a pivot 39 on the rail 37 for abutting the wheel 23 and holding it in operative position, and the stop 38 can be pivotted downwardly to clear the wheel 23 when the mechanism 21 is to be retracted from underneath the stacker and moved to the left, as viewed in FIG. 1, as mentioned. A compression spring 41 can hold the stop 38 upwardly to position it against the wheel 23 for the operating position of the mechanism 21.

FIG. 3 shows the mechanisms 21 supported in a clamp 24, as mentioned, and a guide rod 42 extends between the side frame members 43 which also support the fluid cylinder 44, in the manner mentioned in connection with FIG. 2. Of course in FIG. 3 the two mechanisms are shiftable left and right, so that either one of the mechanisms can again be placed in the operative position on the center plane which is the position of the strap guide segment 13.

With that arrangement, the strap mechanisms 21 are movable in a first direction which is transverse to the plane defined by the segment 13, for selective positioning of either mechanism 21 in the operating position on that center plane. Further, as shown in FIG. 1, the mechanisms 21 are movable in the second direction which is transverse to the first direction, such as when rolling on the wheels 23, and then the mechanisms 21 are available for removal for servicing or whatever. Of course it will be understood that with the two mechanisms 21 available at all times, and each having its own strap supply 32 and 34, respectively, the mechanism which is in operating condition and which has a supply of strap is the one that can be readily and easily positioned on the center plane while the other one is being readied for its turn in service.

What is claimed is:

1. A method for supplying strap to encircle an item positioned on a strapper, comprising the steps of positioning an item on a strapper having only a segment of a strap guide disposed on a plane in a fixed position and with the item being positioned on said plane to be strapped therealong, movably supporting two strapping mechanisms adjacent said segment and with each of said mechanisms having a strap guide segment matable with the first said segment, and selectively positioning either one of said two strapping mechanisms into mating relationship with the first said segment for strapping the item.

2. The method for supplying strap to encircle an item positioned on a strapper as claimed in claim 1, including moving said two strapping mechanisms laterally of said plane and alternately into and out of said plane for alternate mating with the first said segment.

3. The method for supplying strap to encircle an item positioned on a strapper as claimed in claim 2, including moving said two strapping mechanisms parallel to said plane for servicing.

4. Apparatus for supplying strap to encircle an item, comprising a first segment of a strap guide disposed in a fixed position and being discontinuous by having two free ends spaced apart, two strapping mechanisms movably disposed adjacent said first segment and each thereof having a second segment of a strap guide of a length equal to the length of the space between said two free ends and being movable in a direction and into said space and arranged to form a continuous strap guide with said first segment, and a mobile mounting supporting said two strapping mechanisms for alternately positioning said two strapping mechanisms with the respective one of said second segments positioned to form said continuous strap guide.

5. The apparatus for supplying strap to encircle an item as claimed in claim 4, including a powered means connected with said strapping mechanisms for positioning said strapping mechanisms relative to said first segment.

6. The apparatus for supplying strap to encircle an item as claimed in claim 4, including a separate supply of strap available with each respective one of said strapping mechanisms.

7. The apparatus for supplying strap to encircle an item as claimed in claim 4, wherein said mobile mounting includes guides extending transverse to the direction of the length of said first segment for mobile support of said strapping mechanisms and thereby rendering the latter shiftable.

8. The apparatus for supplying strap to encircle an item as claimed in claim 4, including an additional mobile mounting supporting each of said strapping mechanisms for separately mobilizing said strapping mechanisms in a direction oblique to the first-mentioned direction of movement of said strapping mechanisms for servicing of said strapping mechanisms.

9. The apparatus for supplying strap to encircle an item as claimed in claim 8, including a separate supply of strap available with each respective one of said strapping mechanisms.

10. The apparatus for supplying strap to encircle an item as claimed in claim 8, including an interconnector connected between all said mobile mountings and thereby said additional mobile mounting being movable with said strapping mechanisms in the first said direction.

11. A method for applying strap to encircle an item positioned on a strapper, comprising the steps of positioning an item on a center plane on a strapper and with the item being positioned on said plane to be strapped therealong, movably supporting two strapping mechanisms in side-by-side positions and relative to said center plane and with each of said mechanisms having a strap guide positionable on said center plane, and selectively positioning either one of said two strapping mechanisms onto said center plane by shifting said strapping mechanisms off and onto said center plane and into position for strapping the item.

12. The method for applying strap to encircle an item positioned on a strapper as claimed in claim 11, including moving said two strapping mechanisms laterally of said plane and alternately into and out of said plane for alternate aligning with said plane, and supplying a respective supply of strap material for each of said strapping mechanisms.

13. Apparatus for applying strap onto a center plane of an item to encircle the item, comprising two strapping mechanisms movably disposed adjacent each other, and a mounting movably supporting said two strapping mechanisms for moving said strapping mechanisms in a direction transverse to said center plane for alternately positioning said two strapping mechanisms onto said center plane for respectively applying a strap to the item on said center plane.

14. The apparatus for applying strap to encircle an item as claimed in claim 13, including a powered means connected with said strapping mechanisms for moving said strapping mechanisms on said mounting and relative to said center plane.

15. The apparatus for applying strap to encircle an item as claimed in claim 13, including a separate supply of strap available with each respective one of said strapping mechanisms.

16. The apparatus for applying strap to encircle an item as claimed in claim 13, wherein said mounting includes guides extending transverse to said center plane for mobile support of said strapping mechanisms and thereby rendering the latter shiftable.

17. The apparatus for applying strap to encircle an item as claimed in claim 13, including an additional mounting supporting each of said strapping mechanisms for separately mobilizing said strapping mechanisms in a direction parallel to said center plane, for servicing of said strapping mechanisms.

18. The apparatus for applying strap to encircle an item as claimed in claim 17, including an interconnector connected between both said mountings and thereby said additional mounting being movable with said strapping mechanisms in the said transverse direction.

* * * * *